US008888084B1

(12) United States Patent
Aldredge et al.

(10) Patent No.: US 8,888,084 B1
(45) Date of Patent: Nov. 18, 2014

(54) SAW HORSE PIPE CLAMP

(71) Applicants: Robert L. Aldredge, Englewood, OH (US); Daniel J Schaefer, Huber Heights, OH (US)

(72) Inventors: Robert L. Aldredge, Englewood, OH (US); Daniel J Schaefer, Huber Heights, OH (US)

( * ) Notice: Subject to any disclaimer, the term of this patent is extended or adjusted under 35 U.S.C. 154(b) by 0 days.

(21) Appl. No.: 14/243,175

(22) Filed: Apr. 2, 2014

(51) Int. Cl.

| | |
|---|---|
| ***B25B 1/22*** | (2006.01) |
| ***B25B 5/14*** | (2006.01) |
| ***B25B 5/00*** | (2006.01) |
| ***B25B 5/02*** | (2006.01) |

(52) U.S. Cl.
CPC ..... *B25B 5/147* (2013.01); *B25B 5/006* (2013.01); *B25B 5/02* (2013.01)
USPC ..... 269/95; 269/166; 269/3; 269/6

(58) Field of Classification Search
USPC ..... 269/95, 3, 6, 166–170, 176, 266, 229, 269/236, 252, 171.5
See application file for complete search history.

(56) References Cited

U.S. PATENT DOCUMENTS

| | | | | |
|---|---|---|---|---|
| 3,218,058 | A * | 11/1965 | Smith | 269/166 |
| 4,132,397 | A * | 1/1979 | Ward | 269/252 |
| 5,692,734 | A * | 12/1997 | Aldredge, Sr. | 269/166 |
| 5,775,680 | A * | 7/1998 | Sorensen et al. | 269/170 |
| 6,338,478 | B2 * | 1/2002 | Baculy | 269/166 |
| 6,554,264 | B1 * | 4/2003 | Alford | 269/147 |
| 7,066,457 | B2 * | 6/2006 | Gerritsen et al. | 269/6 |
| 7,131,643 | B1 * | 11/2006 | Sankey, II | 269/203 |
| 7,600,744 | B2 * | 10/2009 | Liou | 269/166 |
| 2005/0156368 | A1 * | 7/2005 | Fuller | 269/170 |
| 2009/0008850 | A1 * | 1/2009 | Liou | 269/166 |

* cited by examiner

*Primary Examiner* — Lee D Wilson
(74) *Attorney, Agent, or Firm* — Donald J. Ersler

(57) ABSTRACT

A saw horse pipe clamp preferably includes a support rod, a first mounting bracket, a second mounting bracket, a slidable clamp jaw, a tightening clamp jaw, a clamp housing, a clamp screw and an angular adjustment device. The first mounting bracket is attached to a first end of a saw horse and the second mounting bracket is attached to a second end of the saw horse. The support rod is rotatably retained in the first mounting bracket. The clamp jaws are slidably retained on the support rod. The clamp housing is secured to an end of the support rod. The clamp housing is rotatably retained by the second support bracket. The clamp screw is threaded into the clamp housing and an end of the clamp screw is rotatably engaged with the tightening clamp jaw. The angular adjustment device is tightened to prevent rotation of the clamp housing.

16 Claims, 5 Drawing Sheets

SAW HORSE PIPE CLAMP

BACKGROUND OF THE INVENTION

1. Field of the Invention

The present invention relates generally to construction and more specifically to a saw horse pipe clamp, which allows objects to be clamped on a saw horse.

2. Discussion of the Prior Art

U.S. Pat. No. 4,132,397 to Ward discloses a mounting bracket for a pipe clamp. However, Ward requires an operator to use two open end wrenches to adjust an angle of the clamp jaws relative to the saw horse, while holding the jaws at the desired angle relative to the saw horse. U.S. Pat. No. 5,692,734 to Aldredge, Sr. discloses a clamp structure. However, Aldredge requires an operator to clamp an object and choose an angle of the clamp jaws relative to the saw horse at the same time.

Accordingly, there is a clearly felt need in the art for a saw horse pipe clamp, which does not require hand tools to adjust an angle of the clamp jaws relative to the saw horse, but allows an operator to clamp an object and an adjust an angle of the clamp jaws relative to the saw horse in two steps.

SUMMARY OF THE INVENTION

The present invention provides a saw horse pipe clamp, which allows objects to be clamped on a saw horse. The saw horse pipe clamp preferably includes a support rod, a first mounting bracket, a second mounting bracket, a slidable clamp jaw, a tightening clamp jaw, a clamp housing, a clamp screw and an angular adjustment device. The first mounting bracket is attached to a first end of a saw horse and the second mounting bracket is attached to a second end of the saw horse. A hole is formed through an end of the first mounting bracket to rotatably receive the support rod. The slidable clamp jaw is slidably retained on the support rod. The slidable clamp jaw includes spring loaded clamp levers for retaining an axial and angular position on the support rod. The tightening clamp jaw is slidably retained on the support rod. The clamp housing is secured to an end of the support rod. A hole is formed through the second support bracket to rotatably receive an end of the clamp housing. The clamp screw is threadably engaged with clamp housing and an end of the clamp screw is rotatably engaged with the tightening clamp jaw. The angular adjustment device is tightened to prevent rotation between the clamp housing and the second mounting bracket.

Accordingly, it is an object of the present invention to provide a saw horse pipe clamp, which does not require hand tools to adjust an angle of the clamp jaws relative to the saw horse.

Finally, it is another object of the present invention to provide a saw horse pipe clamp, which allows an operator to clamp an object and an adjust an angle of the clamp jaws relative to the saw horse in two steps.

These and additional objects, advantages, features and benefits of the present invention will become apparent from the following specification.

DETAILED DESCRIPTION OF THE PREFERRED EMBODIMENTS

Figure 1:
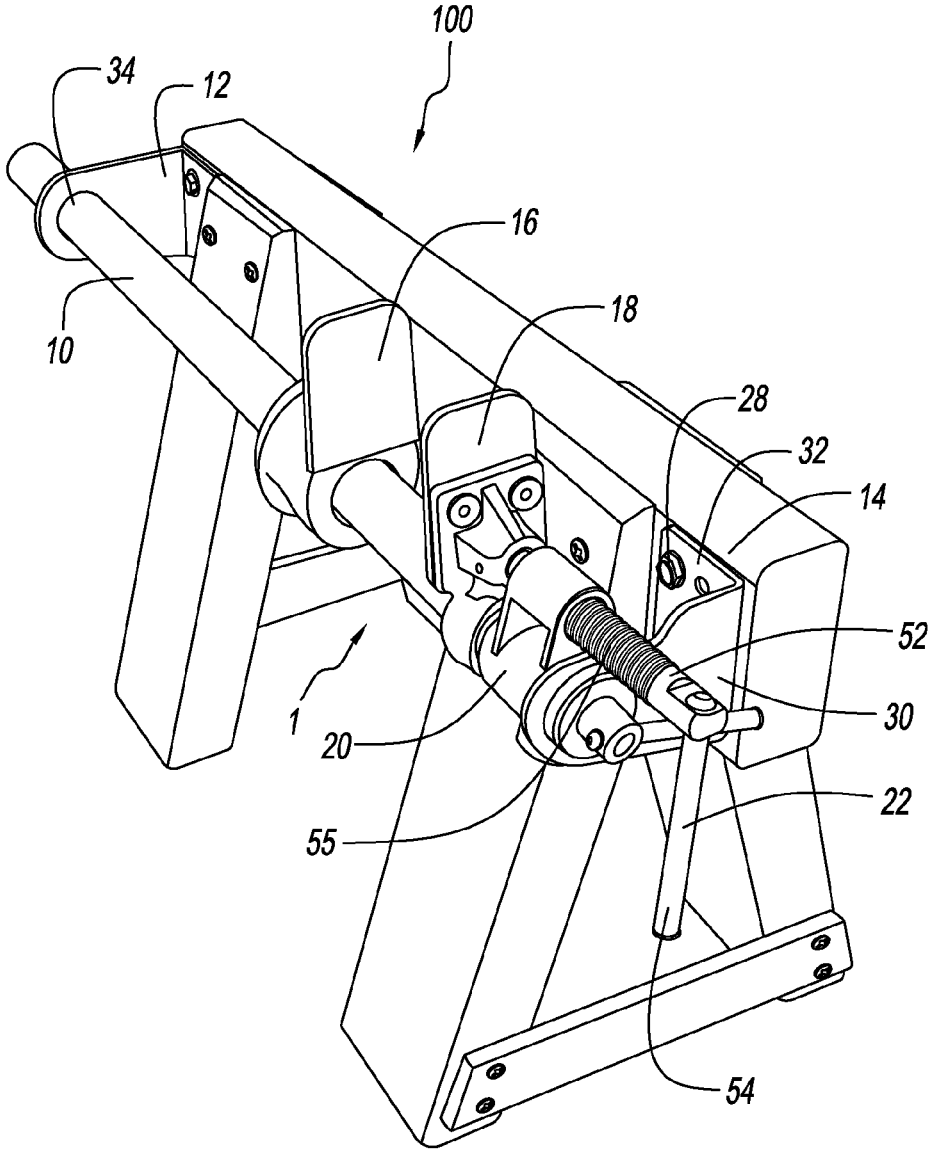
FIG. 1 is a perspective view of a saw horse pipe clamp attached to a saw horse in accordance with the present invention.
Figure 2:
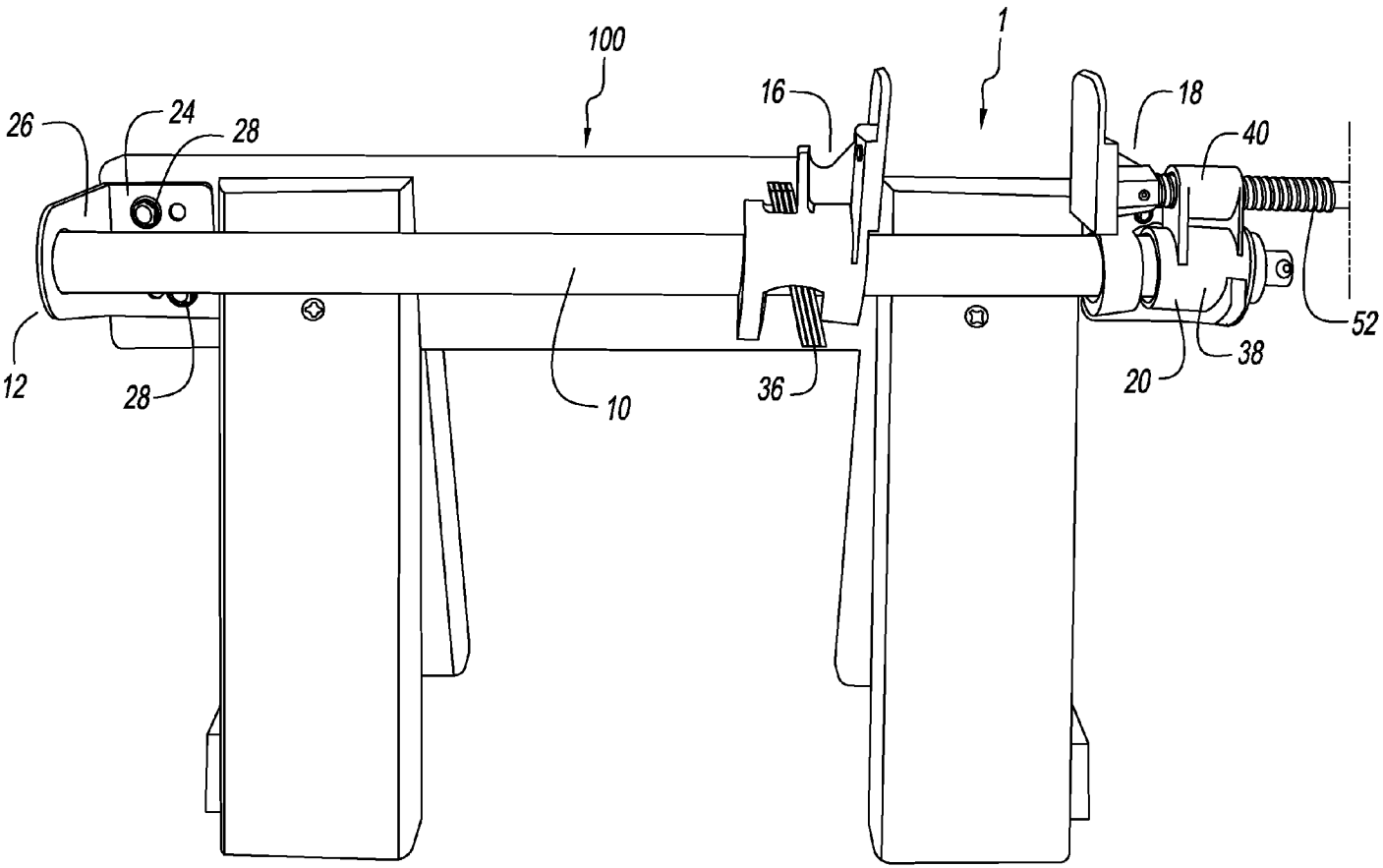
FIG. 2 is a side perspective view of a saw horse pipe clamp attached to a saw horse in accordance with the present invention.
Figure 3:
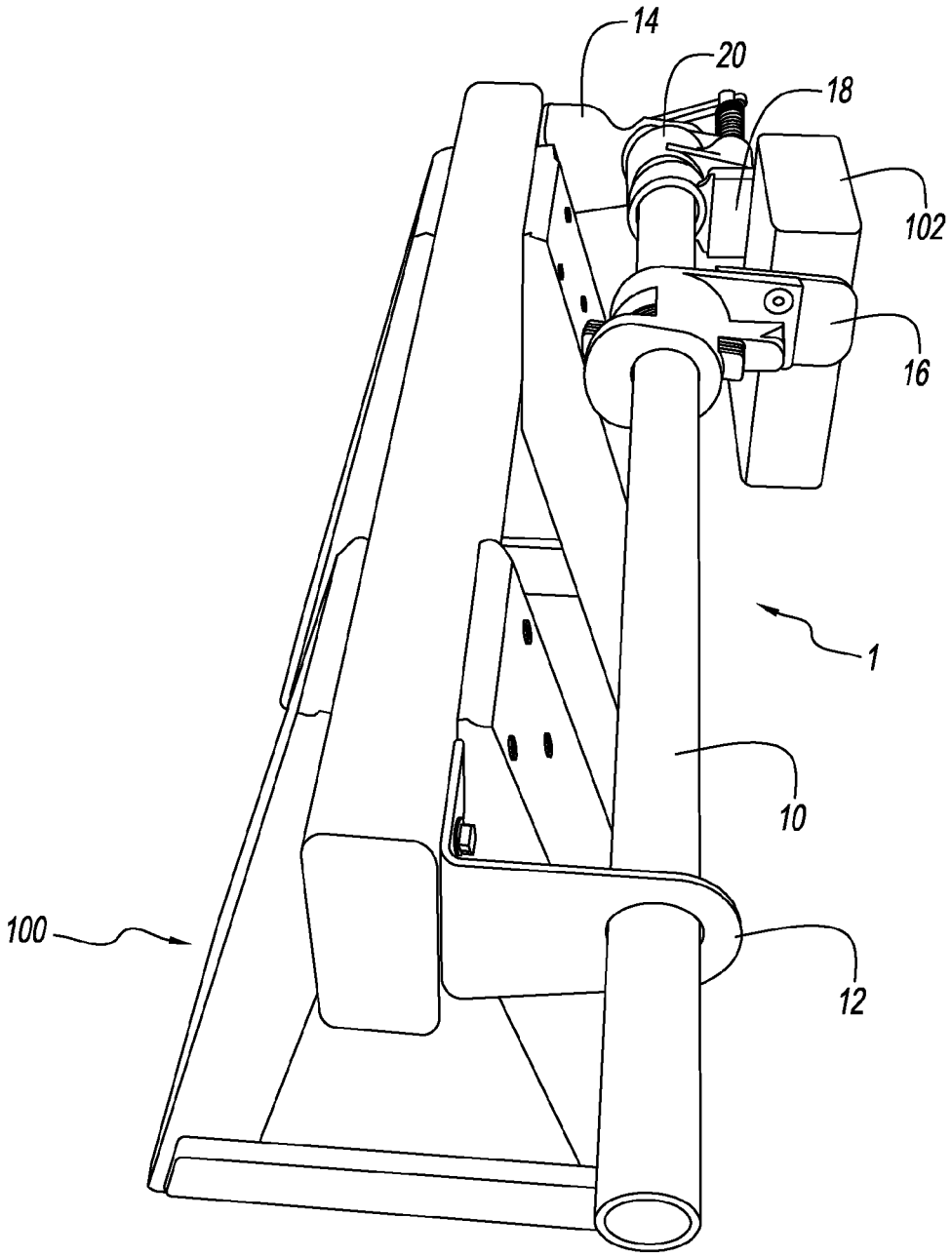
FIG. 3 is an end perspective view of a saw horse pipe clamp rotated 90 degrees from a position shown in FIG. 1 and with an object clamped therein in accordance with the present invention.

With reference now to the drawings, and particularly to FIG. 1, there is shown a perspective view of a saw horse pipe clamp 1. With reference to FIGS. 2-3, the saw horse pipe clamp 1 preferably includes a support rod 10, a first mounting bracket 12, a second mounting bracket 14, a slidable clamp jaw 16, a tightening clamp jaw 18, a clamp housing 20, a clamp screw 22 and an angular adjustment device. The support rod 10, the first mounting bracket 12, the second mounting bracket 14, the slidable clamp jaw 16, the tightening clamp jaw 18, the clamp housing 20 and the clamp screw 22 are preferably obtained from a pipe clamp purchased from Harbor Freight. However, other pipe clamps may also be used.

The first mounting bracket 12 includes a first rod holder plate 24 and a first flange 26. The first rod holder plate 24 extends outward from an end of the first flange 26. The first flange 26 is attached to a first end of a saw horse 100 with at least two screws 28. The second mounting bracket 14 includes a second rod holder plate 30 and a second flange 32. The second rod holder plate 30 extends outward from an end of the second flange 32. The second flange 32 is attached to a second end of the saw horse 100 with at least two screws 28 or the like. A hole 34 is formed through the first rod holder plate 24 to rotatably receive the support rod 10.

Figure 4:
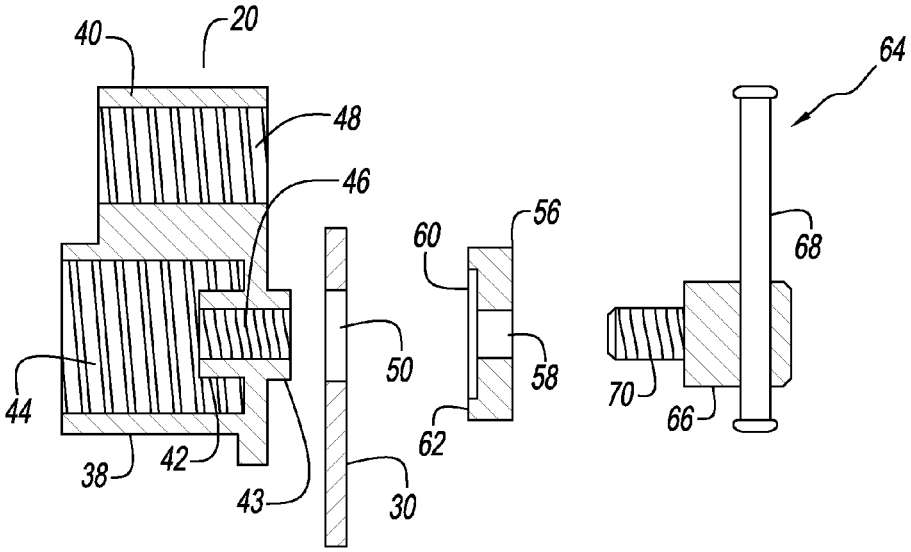
FIG. 4 is an exploded side cross sectional view of an angular clamping bolt, a ring washer, a second rod holder plate and a clamp housing for adjusting an angular position of clamp jaws relative to a saw horse of a saw horse pipe clamp in accordance with the present invention.

The slidable clamp jaw 16 is slidably retained on the support rod 10. The slidable clamp jaw 16 includes spring loaded clamp levers 36 for retaining an axial position on the support rod 10. The tightening clamp jaw 18 is slidably retained on the support rod 10. With reference to FIG. 4, the clamp housing 20 includes a rod boss 38, an adjustment boss 40, an inner angular adjustment boss 42 and an outer angular adjustment boss 43. A rod thread 44 is formed in the rod boss 38 to threadably receive an end of the support rod 10. The inner angular adjustment boss 42 extends into the rod thread and the outer angular adjustment boss 43 extends from an end of the rod boss 38. An angular adjustment thread 46 is formed through the inner and outer angular adjustment bosses 42, 43. A clamp thread 48 is formed through the adjustment boss 40. A pivot hole 50 is formed through the second rod holder plate 30 to rotatably receive the outer angular adjustment boss 43.

The clamp screw 22 includes a rod portion 52 and a sliding clamp lever arm 54. The sliding clamp lever arm 54 is slidably engaged with one end of the threaded rod 52. A threaded portion 55 is formed on substantially the other end of the rod portion 52. The clamp screw 22 is tightened to retain an object 102 between the clamp jaws 16, 18. The threaded portion 55 is threadably engaged with the clamp thread 48. The other end of the rod portion 52 is rotatably engaged with the tightening clamp jaw 18. A clamp washer 56 includes a hole 58 and a counterbore 60. The hole 58 is formed through the clamp washer 56. The counterbore 60 is formed in one end of the clamp washer 56 to create a ring surface 62. An angular adjustment screw 64 includes a base 66 and a sliding lever arm 68. The sliding lever arm 68 is slidably engaged with the base 66. A threaded stud 70 extends from the base 66. The threaded stud 70 is inserted through the hole 58, the pivot hole 50 and threaded into the angular adjustment thread 46. The angular adjustment screw 64 is tightened to prevent rotation of the clamp jaws 16, 18 relative to the saw horse 100. Securing the angular adjustment of the clamp jaws 16, 18 relative to the saw horse 100 does not require separate hand tools and may be done separately.

Figure 5:
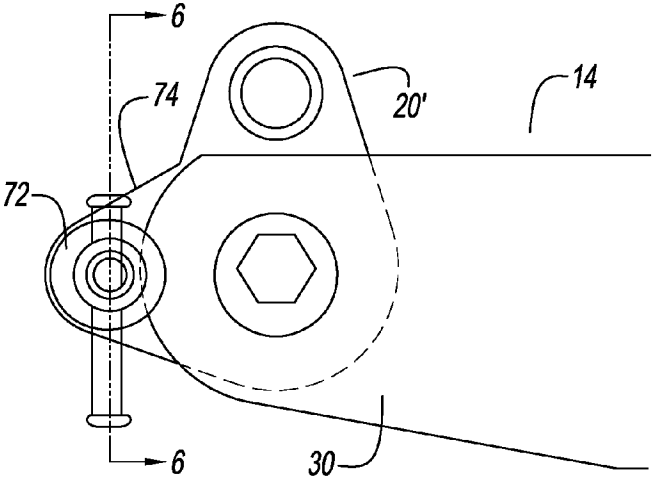
FIG. 5 is a front view of an angular clamping bolt, a stepped washer, a second rod holder plate and a modified clamp housing for adjusting an angular position of clamp jaws relative to a saw horse of a saw horse pipe clamp in accordance with the present invention.
Figure 7:
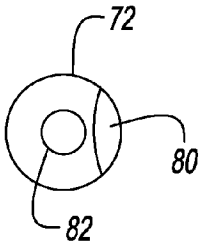
FIG. 7 is a rear view of a stepped washer for adjusting an angular position of clamp jaws relative to a saw horse of a saw horse pipe clamp in accordance with the present invention.
Figure 6:
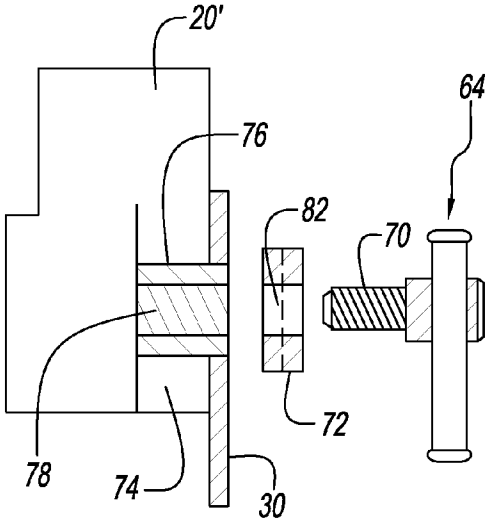
FIG. 6 is an exploded side cross sectional view of an angular clamping bolt, a stepped washer, a second rod holder plate and a modified clamp housing for adjusting an angular position of clamp jaws relative to a saw horse of a saw horse pipe clamp in accordance with the present invention.

With reference to FIGS. 5-7, a second embodiment of an angular adjustment device includes the angular adjustment screw 64, a step washer 72 and a modified clamp housing 20'. The inner and outer angular adjustment bosses 42, 43 are replaced with an angular adjustment boss 74. The angular adjustment boss 74 extends from a side of the modified clamp housing 20'. The angular adjustment boss 74 includes a thread base 76. An angular adjustment thread 78 is formed through the thread base 76. The step washer 72 includes a scalloped slot 80 and a hole 82. The hole 82 is formed through the step washer 72. The scalloped slot 80 has a depth that is slightly less than a thickness of the second rod holder plate 30. The threaded stud 70 is inserted through the hole 82, the pivot hole 50 and threaded into the angular adjustment thread 78. The angular adjustment screw 64 is tightened to prevent rotation of the clamp jaws 16, 18 relative to the saw horse 100. Securing the angular adjustment of the clamp jaws 16, 18 relative to the saw horse 100 does not require separate hand tools and may be done separately.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A saw horse pipe clamp comprising:

a support rod;

a first mounting bracket, a first end of said support rod is retained in said first mounting bracket, wherein said first mounting bracket is attached to a first end of a saw horse;

a second mounting bracket, wherein said second mounting bracket is attached to a second end of the saw horse;

a slidable clamp jaw is slidably retained on said support rod;

a tightening clamp jaw is slidably retained on said support rod;

a clamp housing, a second end of said rod support is secured to said clamp housing;

a clamp screw includes a rod portion and a lever arm, said rod portion is threadably engaged with said clamp housing, an end of said rod portion is rotatably engaged with said tightening clamp jaw; and an angular adjustment device is tightened to prevent rotation of said clamp housing relative to the saw horse, said angular adjustment device is normally engaged with said clamp housing.

2. The saw horse pipe clamp of claim 1 wherein:

said second end of said support rod is threaded into said clamp housing.

3. The saw horse pipe clamp of claim 1 wherein:

said clamp housing includes an angular adjustment boss, a angular adjustment thread is formed in said angular adjustment boss to threadably engage said angular adjustment device.

4. The saw horse pipe clamp of claim 1 wherein:

said first and second mounting brackets are attached to a vertical surface of the saw horse.

5. A saw horse pipe clamp comprising:

a support rod;

a first mounting bracket, a first end of said support rod is retained in said first mounting bracket, wherein said first mounting bracket is attached to a first end of a saw horse;

a second mounting bracket, wherein said second mounting bracket is attached to a second end of the saw horse;

a slidable clamp jaw is slidably retained on said support rod;

a tightening clamp jaw is slidably retained on said support rod;

a clamp housing, a second end of said rod support is secured to said clamp housing;

a clamp screw includes a rod portion and a lever arm, said rod portion is threadably engaged with said clamp housing, an end of said rod portion is rotatably engaged with said tightening clamp jaw; and an adjustment screw includes a threaded rod and a lever arm, said lever arm is retained by said threaded rod, wherein said adjustment screw is tightened to prevent rotation of said clamp housing relative to the saw horse, said adjustment screw is normally engaged with said clamp housing.

6. The saw horse pipe clamp of claim 1 wherein:

a rod thread is formed in said clamp housing, said second end of said support rod is threaded into said rod thread.

7. The saw horse pipe clamp of claim 6 wherein:

said clamp housing includes an angular adjustment boss, said angular adjustment boss is partially located in said rod thread, an angular adjustment thread is formed in said angular adjustment boss to threadably engage said threaded rod.

8. The saw horse pipe clamp of claim 5 wherein:

an angular adjustment boss extends from a side of said clamp housing, an angular adjustment thread is formed in said angular adjustment boss to threadably engage said threaded rod.

9. The saw horse pipe clamp of claim 1 wherein:

said first and second mounting brackets are attached to a vertical surface of the saw horse.

10. A saw horse pipe clamp comprising:

a support rod;

a first mounting bracket, a first end of said support rod is retained in said first mounting bracket, wherein said first mounting bracket is attached to a first end of a saw horse;

a second mounting bracket, wherein said second mounting bracket is attached to a second end of the saw horse;

a slidable clamp jaw is slidably retained on said support rod;

a tightening clamp jaw is slidably retained on said support rod;

a clamp housing, a second end of said rod support is secured to said clamp housing;

a clamp screw includes a rod portion and a lever arm, said rod portion is threadably engaged with said clamp housing, an end of said rod portion is rotatably engaged with said tightening clamp jaw;

a washer;

an adjustment screw includes a threaded rod and a lever arm, said lever arm is retained by said threaded rod, wherein said threaded rod is inserted through said washer, said adjustment screw is tightened to prevent rotation of said clamp housing relative to the saw horse, said adjustment screw is normally engaged with said clamp housing.

11. The saw horse pipe clamp of claim 10 wherein:

a rod thread is formed in said clamp housing, said second end of said support rod is threaded into said rod thread.

12. The saw horse pipe clamp of claim 10 wherein:

said clamp housing includes an angular adjustment boss, said angular adjustment boss is partially located in said rod thread, an angular adjustment thread is formed in said angular adjustment boss to threadably engage said threaded rod.

13. The saw horse pipe clamp of claim 10 wherein:

an angular adjustment boss extends from a side of said clamp housing, an angular adjustment thread is formed in said angular adjustment boss to threadably engage said threaded rod.

14. The saw horse pipe clamp of claim 10 wherein:

said first and second mounting brackets are attached to a vertical surface of the saw horse.

15. The saw horse pipe clamp of claim 10 wherein:

said washer includes a counterbore formed in an end thereof.

16. The saw horse pipe clamp of claim 10 wherein:

said washer includes a scalloped slot, said scalloped slot has a depth that is slightly less than a thickness of said mounting bracket.

* * * * *